US009644247B2

(12) United States Patent
Matsuda et al.

(10) Patent No.: US 9,644,247 B2
(45) Date of Patent: May 9, 2017

(54) METHODS FOR MANUFACTURING A HIGH-STRENGTH PRESS-FORMED MEMBER

(71) Applicant: JFE Steel Corporation, Tokyo (JP)

(72) Inventors: Hiroshi Matsuda, Tokyo (JP); Yoshimasa Funakawa, Tokyo (JP); Yasushi Tanaka, Tokyo (JP)

(73) Assignee: JFE Steel Corporation (JP)

( * ) Notice: Subject to any disclaimer, the term of this patent is extended or adjusted under 35 U.S.C. 154(b) by 524 days.

(21) Appl. No.: 14/100,438

(22) Filed: Dec. 9, 2013

(65) Prior Publication Data

US 2014/0096876 A1 Apr. 10, 2014

Related U.S. Application Data

(62) Division of application No. 13/583,407, filed as application No. PCT/JP2011/001164 on Feb. 28, 2011, now Pat. No. 8,992,697.

(30) Foreign Application Priority Data

Mar. 9, 2010 (JP) ..... 2010-052366

(51) Int. Cl.
*C21D 8/00* (2006.01)
*C21D 7/13* (2006.01)
(Continued)

(52) U.S. Cl.
CPC ..... *C21D 8/0247* (2013.01); *C21D 1/22* (2013.01); *C21D 8/0205* (2013.01); *C21D 9/46* (2013.01);
(Continued)

(58) Field of Classification Search
None
See application file for complete search history.

(56) References Cited

U.S. PATENT DOCUMENTS

2006/0137768 A1 6/2006 Yuse et al.
2008/0000555 A1 1/2008 Nonaka et al.
(Continued)

FOREIGN PATENT DOCUMENTS

CN 101035921 9/2007
EP 2 267 176 12/2010
(Continued)

OTHER PUBLICATIONS

English translation of Japanese patent publication No. 02-153019, Miwa Yoshihisa, Jun. 12, 1990.*
(Continued)

*Primary Examiner* — Deborah Yee
(74) *Attorney, Agent, or Firm* — DLA Piper LLP (US)

(57) ABSTRACT

A method for manufacturing a high strength press-formed member includes preparing a steel sheet having the composition including by mass %: C: 0.12% to 0.69%, Si: 3.0% or less, Mn: 0.5% to 3.0%, P: 0.1% or less, S: 0.07% or less, Al: 3.0% or less, N: 0.010% or less, Si+Al: at least 0.7%, and remainder as Fe and incidental impurities, heating the steel sheet to a temperature of 750° C. to 1000° C. and retaining the steel sheet in that state for 5 seconds to 1000 seconds; subjecting the steel sheet to hot press-forming at a temperature of 350° C. to 900° C.; cooling the steel sheet to a temperature of 50° C. to 350° C.; heating the steel sheet to a temperature in a temperature region of 350° C. to 490° C.; and retaining the steel sheet at temperature in the temperature region for 5 seconds to 1000 seconds.

10 Claims, 1 Drawing Sheet

(51) Int. Cl.

| | |
|---|---|
| ***C21D 8/02*** | (2006.01) |
| ***C21D 1/22*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.
CPC ..... *C22C 38/001* (2013.01); *C22C 38/02* (2013.01); *C22C 38/04* (2013.01); *C22C 38/06* (2013.01); *C21D 2211/001* (2013.01); *C21D 2211/002* (2013.01); *C21D 2211/008* (2013.01)

(56) References Cited

U.S. PATENT DOCUMENTS

| | | | | |
|---|---|---|---|---|
| 2008/0308194 | A1* | 12/2008 | Corquillet ..... | C21D 1/185 148/531 |
| 2009/0277547 | A1 | 11/2009 | Saito et al. | |
| 2011/0146852 | A1 | 6/2011 | Matsuda et al. | |
| 2012/0132327 | A1 | 5/2012 | Mukai et al. | |

FOREIGN PATENT DOCUMENTS

| | | | |
|---|---|---|---|
| GB | 1 490 545 | | 11/1977 |
| GB | 1490535 | * | 11/1977 |
| JP | 2005-205477 | A | 8/2005 |
| JP | 2006-183139 | A | 7/2006 |
| JP | 2007-16296 | A | 1/2007 |
| WO | 2007/034063 | | 3/2007 |
| WO | 2009/099079 | | 8/2009 |

OTHER PUBLICATIONS

US Advisory Action dated Jun. 25, 2014 from corresponding U.S. Appl. No. 13/583,407.

Supplementary European Search Report dated May 28, 2014 from corresponding European Application No. 11 75 2999.

Chinese Official Action dated Jan. 21, 2014 from corresponding Chinese Patent Application No. 201180023411.7 (including an English translation).

US Official Action dated Mar. 18, 2014 from corresponding U.S. Appl. No. 13/583,407.

US Official Action dated Aug. 7, 2014 from related U.S. Appl. No. 13/583,407.

European Communication of a notice of opposition dated Jul. 6, 2016, of corresponding European Application No. 11752999.0.

Altan, T., "Hot-stamping boron-alloyed steels for automotive parts—Part I: Process methods and uses," *Stamping Journal*, Dec. 2006, pp. 40-41.

Mori, K., et al., "Warm and Hot Stamping of Ultra High Tensile Strength Steel Sheets Using Resistance Heating," *CIRP annals, Manufacturing Technology*, vol. 54, 2005, pp. 209-212.

* cited by examiner

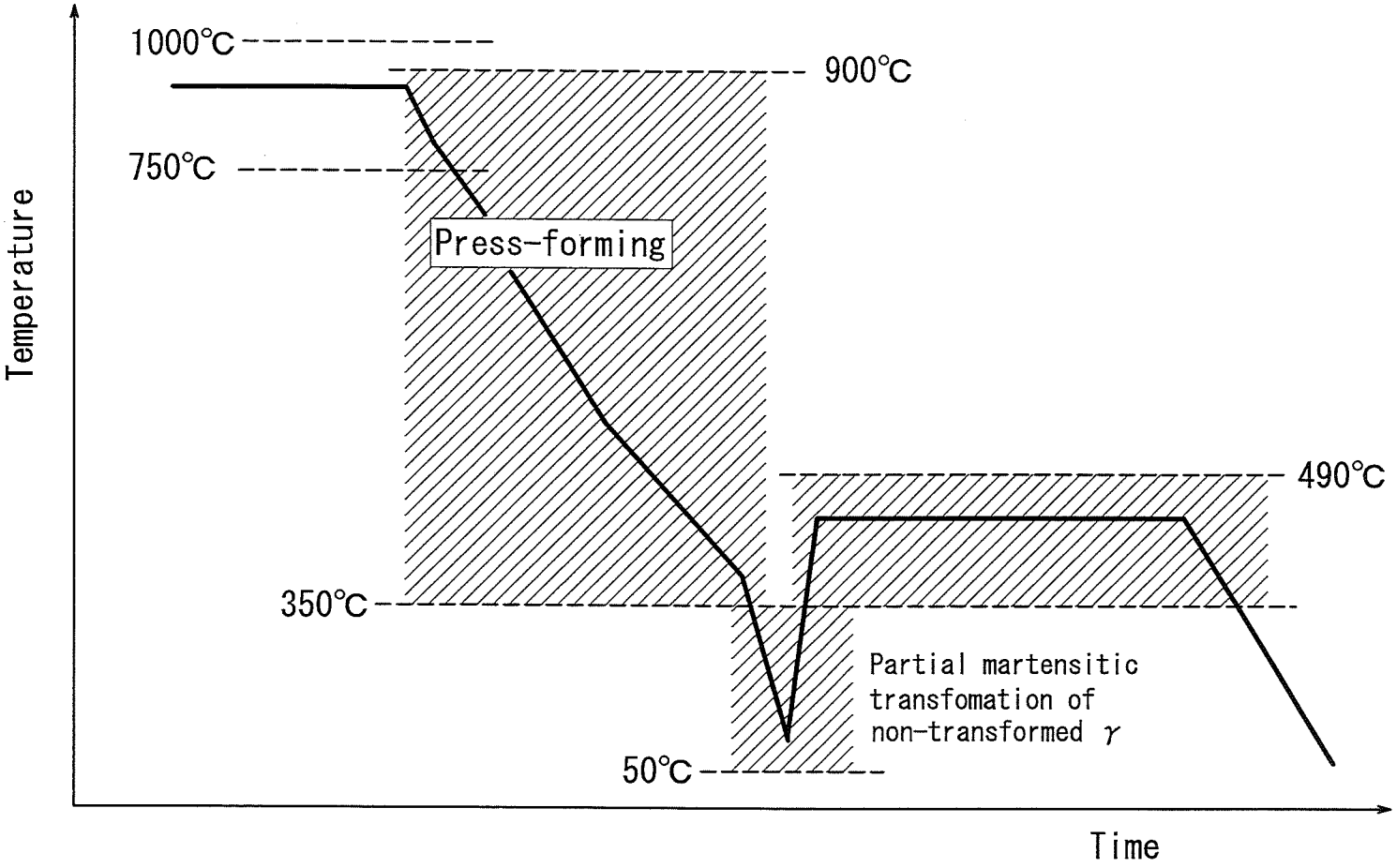
1000°C
750°C
900°C
Press-forming
350°C
490°C
Partial martensitic transfomation of non-transformed γ
50°C
Temperature
Time

METHODS FOR MANUFACTURING A HIGH-STRENGTH PRESS-FORMED MEMBER

RELATED APPLICATIONS

This is a divisional application of U.S. patent application Ser. No. 13/583,407 filed Nov. 6, 2012, now U.S. Pat. No. 8,992,697 issued Mar. 31, 2015, which is a §371 of International Application No. PCT/JP2011/001164, with an international filing date of Feb. 28, 2011 (WO 2011/111333 A1, published Sep. 15, 2011), which is based on Japanese Patent Application No. 2010-052366, filed Mar. 9, 2010.

TECHNICAL FIELD

This disclosure relates to a high strength press-formed member mainly for use in the automobile industry, in particular, a high strength press-formed member having tensile strength (TS) of at least 980 MPa and prepared by hot press-forming a heated steel sheet within a mold constituted of a die and a punch. The disclosure also relates to a method for manufacturing the high strength press-formed member.

BACKGROUND

Improving fuel efficiency of automobiles has been an important task in recent years from the viewpoint of global environment protection. Accordingly, there has been a vigorous trend toward making vehicle body parts thin by increasing the strength of vehicle body material to reduce weight of vehicles. However, these vehicle body parts, each generally manufactured by press-forming a steel sheet having a desired strength, exhibit deteriorated formability as strength thereof increases and cannot be reliably formed into a desired member shape.

In view of this, GBP 1490535 discloses what is called "hot/warm press forming" as a method for manufacturing a member by press-forming a heated steel sheet in a mold and then immediately and rapidly cooling the steel sheet to increase the strength thereof. The method has already been applied to manufacturing some members requiring TS in the range of 980 MPa to 1470 MPa. This method characteristically alleviates the aforementioned formability deterioration problem as compared to what is called "cold press-forming" at room temperature, and can highly increase the strength of a subject member by utilizing a low-temperature transformed microstructure obtained by water-quenching.

However, some structural members for use in automobiles, e.g. a side member, require high ductility in terms of ensuring safety during a collision and the conventional hot/warm press-formed member as disclosed in GBP 1490535 does not necessarily exhibit satisfactory ductility in this regard.

In view of this, there has been proposed as disclosed in JP-A 2007-016296 a hot press-formed member manufactured by hot press-forming a steel sheet at a temperature in the two-phase region of (ferrite+austenite) such that the steel sheet has: dual-phase microstructure constituted of 40%-90% ferrite and 10%-60% martensite by area ratio after hot press-forming; TS in the range of 780 MPa to 1180 MPa class; and excellent ductility of total elongation in the range of 10% to 20%.

However, the hot press-formed member disclosed in JP-A 2007-016296 does not reliably exhibit sufficient ductility, although the member has tensile strength around 1270 MPa. Therefore, it is still necessary to develop a member having high strength and excellent ductility in a compatible manner to achieve further reduction of automobile body weight.

It could therefore be helpful to provide a high strength press-formed member having tensile strength of at least 980 MPa and excellent ductility of (TS×T.EL.)≥17000 (MPa·%), as well as an advantageous manufacturing method of the high strength press-formed member.

SUMMARY

We discovered that it is possible to obtain a high strength press-formed member excellent in strength and ductility and having tensile strength of at least 980 MPa by: highly increasing the strength of a steel sheet by utilizing a martensite microstructure; ensuring retained austenite which is advantageous in terms of obtaining a TRIP (Transformation induced Plasticity) effect, in a stable manner by increasing carbon content in the steel sheet to a relatively high level, i.e. at least 0.12 mass %; utilizing bainitic transformation; and tempering a portion of the martensite.

A tempered state of martensite and a state of retained austenite, in particular, were studied in detail. As a result, we discovered that tempered martensite, retained austenite and bainitic ferrite are adequately made into a composite material and thus a high strength hot press-formed member having high strength and excellent ductility can be manufactured by cooling a steel sheet before retained austenite is rendered stable due to bainitic transformation, to allow a portion of the martensite to be formed.

We thus provide:

(1) A high strength press-formed member obtainable by hot press-forming, characterized in that a steel sheet constituting the member has a composition including by mass %, C: 0.12% to 0.69%, Si: 3.0% or less, Mn: 0.5% to 3.0%, P: 0.1% or less, S: 0.07% or less, Al: 3.0% or less, N: 0.010% or less, Si+Al: at least 0.7%, and remainder as Fe and incidental impurities, wherein microstructure of the steel sheet constituting the member includes martensite, retained martensite, and bainite containing bainitic ferrite, area ratio of said martensite with respect to the entire microstructure of the steel sheet is in the range of 10% to 85%, at least 25% of said martensite is tempered martensite, content of retained austenite is in the range of 5% to 40%, area ratio of said bainitic ferrite in said bainite with respect to the entire microstructure of the steel sheet is at least 5%, the total of area ratios of said martensite, said retained austenite, and said bainitic ferrite in said bainite with respect to the entire microstructure of the steel sheet is at least 65%, and the average carbon concentration in the retained austenite is at least 0.65 mass %.

(2) The high strength press-formed member of (1) above, wherein the composition of the steel sheet constituting the member further includes by mass % at least one type of elements selected from Cr: 0.05% to 5.0%, V: 0.005% to 1.0%, and Mo: 0.005% to 0.5%.

(3) The high strength press-formed member of (1) or (2) above, wherein the composition of the steel sheet constituting the member further includes by mass % at least one type of elements selected from Ti: 0.01% to 0.1%, and Nb: 0.01% to 0.1%.

(4) The high strength press-formed member of any of (1) to (3) above, wherein the composition of the steel sheet constituting the member further includes by mass %, B: 0.0003% to 0.0050%.

(5) The high strength press-formed member of any of (1) to (4) above, wherein the composition of the steel sheet constituting the member further includes by mass % at least one type of elements selected from Ni: 0.05% to 2.0%, and Cu: 0.05% to 2.0%.

(6) The high strength press-formed member of any of (1) to (5) above, wherein the composition of the steel sheet constituting the member further includes by mass % at least one type of elements selected from Ca: 0.001% to 0.005%, and REM: 0.001% to 0.005%.

A method for manufacturing a high strength press-formed member, comprising the steps of: preparing a steel sheet having the component composition of any of (1) to (6) above; heating the steel sheet to temperature in the range of 750° C. to 1000° C. and retaining the steel sheet in that state for 5 seconds to 1000 seconds; subjecting the steel sheet to hot press-forming at temperature in the range of 350° C. to 900° C.; cooling the steel sheet to temperature in the range of 50° C. to 350° C.; heating the steel sheet to temperature in a temperature region ranging from 350° C. to 490° C.; and retaining the steel sheet at temperature in the temperature region for a period ranging from 5 seconds to 1000 seconds.

It is thus possible to obtain a high strength press-formed member excellent in ductility and having tensile strength (TS) of at least 980 MPa. Consequently, we provide a high strength press-formed member which is advantageously applicable to the industrial fields of automobiles, electrical machinery and apparatus, and the like and very useful in particular in terms of reducing the body weight of automobiles.

BRIEF DESCRIPTION OF THE DRAWING

The FIGURE is a diagram showing a temperature range of hot press forming in a method for manufacturing a press-formed member.

DETAILED DESCRIPTION

Our steel sheets and methods will be described in detail hereinafter.

First, reasons for why microstructure of a steel sheet is to be specified as mentioned above will be described. "Area ratio" of a phase represents area ratio of the phase with respect to the entire microstructure of a steel sheet hereinafter.

Area ratio of martensite: 10% to 85%

Martensite, which is a hard phase, is a microstructure necessitated to increase the strength of a steel sheet. Tensile strength (TS) of a steel sheet fails to reach 980 MPa when the area ratio of martensite is less than 10%. An area ratio of martensite exceeding 85% results in insufficient content of bainite and failure in reliably obtaining sufficient content of retrained austenite having relatively high carbon concentration therein in a stable state, thereby causing a problem of deteriorated ductility. Accordingly, the area ratio of martensite is 10% to 85%, preferably 15% to 80%, more preferably 15% to 75%, and particularly preferably 15% to 70%.

Proportion of tempered martensite in the whole martensite phase: at least 25%

A steel sheet may have poor toughness which causes brittle fracture during press-forming, although the steel sheet has tensile strength of at least 980 MPa, in a case where the proportion of tempered martensite with respect to the whole martensite present in the steel sheet is less than 25%.

Martensite which has been quenched, but not yet tempered is very hard and poor in deformability. However, deformability of such brittle martensite as described above remarkably improves by itself by tempering the steel sheet so that ductility and toughness of the steel sheet improve. Therefore, the proportion of tempered martensite with respect to the whole martensite present in a steel sheet is at least 25% and preferably at least 35%. Tempered martensite is visually observed by using a scanning electron microscope (SEM) or the like as a martensite microstructure having fine carbides precipitated therein, which microstructure can be clearly differentiated from quenched, but not tempered martensite having no such carbides therein.

Content of retained austenite: 5% to 40%

Retained austenite experiences martensitic transformation due to a TRIP effect when a steel sheet is processed, thereby contributing to improvement of ductility of the steel sheet through enhanced strain-dispersibility thereof.

Retained austenite having in particular enhanced carbon concentration therein is formed in bainite by utilizing bainitic transformation in the steel sheet. As a result, it is possible to obtain retained austenite capable of causing a TRIP effect in a high strain region when the steel sheet is processed. The steel sheet can exhibit good formability in a high strength region having tensile strength (TS) of at least 980 MPa, specifically has a value of (TS×T. EL.) 17000 (MPa·%) and thus attains good balance between high strength and excellent ductility by allowing retained austenite and martensite to coexist and utilizing these two types of microstructures.

Retained austenite in bainite is formed and finely distributed between laths of bainitic ferrite in bainite, whereby lots of measurements at relatively high magnification are necessary to determine the content (area ratio) thereof through visual observation of the microstructures. In short, it is difficult to accurately carry out quantitative analysis of retained austenite. On the other hand, it has been confirmed that the content of retained austenite formed between laths of bainitic ferrite has a reasonable correlation with the content of bainitic ferrite thus formed.

Therefore, we decided to employ an intensity measuring method based on X-ray diffraction (XRD), which is a conventional technique to measure the content of retained austenite when an area ratio of bainitic ferrite in bainite is equal to or higher than 5%. As a result, we discovered that a sufficient TRIP effect can be obtained and tensile strength (TS) of at least 980 MPa and (TS×T. EL.) of 15000 MPa·% or higher can be both attained when the content of retained austenite calculated from X-ray diffraction intensity ratio of ferrite and austenite in a steel sheet is at least 5%. We also discovered that a retained austenite content obtained by the conventional method or technique for measuring retained austenite content described above is equivalent to an area ratio of the retained austenite with respect to the entire microstructure of the steel sheet.

In a case where the content of retained austenite is less than 5%, a TRIP effect cannot be obtained in a sufficient manner. A content of retained austenite exceeding 40% results in too much hard martensite generated after expression of the TRIP effect, which may cause a problem of deteriorated toughness or the like. Accordingly, the content of retained austenite is 5% to 40%, preferably 5% to 40% (exclusive of 5% and inclusive of 40%), more preferably 10% to 35%, and further more preferably 10% to 30%.

The average carbon concentration in retained austenite: at least 0.65 mass %

Carbon concentration in retained austenite is important in terms of obtaining excellent formability by utilizing a TRIP effect in a high strength steel sheet having tensile strength (TS) in the range of 980 MPa to 2.5 GPa class. Carbon concentration in retained austenite formed between laths of bainitic ferrite in bainite is enhanced in the steel sheet. It is difficult to accurately determine the content of carbon concentrated in retained austenite between laths of bainitic ferrite in bainite. However, we found that satisfactorily excellent formability of a steel sheet can be obtained when the average carbon concentration in retained austenite (the average of carbon concentration distributed within retained austenite), determined from a magnitude of shift of a diffraction peak in X-ray diffraction (XRD) according to the conventional method for measuring the average carbon concentration in retained austenite, is at least 0.65%.

The average carbon concentration in retained austenite lower than 0.65% may cause martensitic transformation to occur in a low strain region in processing of a steel sheet, which results in insufficient TRIP effect in a high strain region (the TRIP effect in a high strain region effectively improves formability of a steel sheet). Accordingly, the average carbon concentration in retained austenite is at least 0.65% and preferably at least 0.90%. The average carbon concentration in retained austenite exceeding 2.00% renders retained austenite too stable, whereby martensitic transformation does not occur during processing of a steel sheet, a TRIP effect fails to be expressed and thus ductility of the steel sheet may deteriorate. Accordingly, the average carbon concentration in retained austenite is preferably 2.00% or less and more preferably 1.50% or less.

Area ratio of bainitic ferrite in bainite: at least 5%

Formation of bainitic ferrite through bainitic transformation is necessary to increase carbon concentration in non-transformed austenite, sufficiently cause a TRIP effect in a high strain region when a steel sheet is processed, and sufficiently obtain retained austenite contributing to enhancing strain-dispersibility of the steel sheet.

The area ratio of bainitic ferrite in bainite with respect to the entire microstructure of a steel sheet need be at least 5%. However, the area ratio of bainitic ferrite in bainite with respect to the entire microstructure of a steel sheet is preferably equal to or lower than 85% because the area ratio exceeding 85% may make it difficult to ensure high strength of a steel sheet.

Transformation from austenite into bainite occurs over a wide temperature range from 150° C. to 550° C. and various types of bainite are formed within this temperature range. The target bainite microstructure is preferably specified in terms of reliably attaining desired formability, although such various types of bainite as described above were simply and collectively referred to as "bainite" in the prior art in general. In a case where bainite is classified into upper bainite and lower bainite, these two types of bainite are defined as follows.

Upper bainite is constituted of lath-like bainitic ferrite, and retained austenite and/or carbide existing between laths of bainitic ferrite and characterized in that it lacks fine carbides regularly aligned between the laths of bainitic ferrite. In contrast, lower bainite, constituted of lath-like bainitic ferrite and retained austenite and/or carbide existing between laths of bainitic ferrite as in upper bainite, does characteristically include fine carbides regularly aligned between the laths of bainitic ferrite.

That is, upper bainite and lower bainite are differentiated by the presence/absence of fine carbides regularly aligned in bainitic ferrite. Such difference in a state of carbide formation in bainitic ferrite as described above significantly affects the degree of carbon concentration into retained austenite.

Upper bainite is more preferable than lower bainite as bainite to be formed in our steel sheets. However, there arises no problem if bainite thus formed is lower bainite or a mixture of upper bainite and lower bainite.

Area ratio of bainite with respect to the entire microstructure of a steel sheet is preferably in the range of 20% to 75%. The total of area ratios of martensite, retained austenite, and bainitic ferrite in bainite: at least 65%

The area ratios of martensite, retained austenite, and bainitic ferrite in bainite individually satisfying the respective preferable ranges thereof described above do not suffice and it is necessary that the total of area ratios of martensite, retained austenite, and bainitic ferrite in bainite with respect to the entire microstructure of the steel sheet is at least 65%. The total of the area ratios described above lower than 65% may result in at least one of insufficient strength and poor formability of a resulting steel sheet. The aforementioned total of area ratios is preferably at least 70% and more preferably at least 75%.

The steel sheet may include polygonal ferrite, pearlite and Widmanstätten ferrite as remaining microstructures. The acceptable content of such remaining microstructures as described above is preferably 30% or less and more preferably 20% or less by area ratio with respect to the entire microstructure of the steel sheet.

Next, reasons for why the component compositions of a steel sheet are to be restricted as mentioned above will be described. The symbol "%" associated with each component composition below represents "mass %".

C: 0.12% to 0.69%

Carbon is an essential element in terms of increasing strength of a steel sheet and reliably obtaining the required content of stable retained austenite. Further, carbon is an element required to ensure the needed content of martensite and making austenite be retained at room temperature. A carbon content in the steel lower than 0.12% makes it difficult to ensure high strength and good formability of a steel sheet. A carbon content exceeding 0.69% significantly hardens a welded portion and surrounding portions affected by welding heat, thereby deteriorating weldability of a steel sheet. Accordingly, the carbon content in the steel is 0.12% to 0.69%, preferably 0.20% to 0.48% (exclusive of 0.20% and inclusive of 0.48%), and more preferably 0.25% to 0.48%.

Si: 3.0% or less

Silicon is a useful element which contributes to increasing the strength of a steel sheet through solute strengthening. However, a silicon content in the steel exceeding 3.0% deteriorates: formability and toughness due to increase in the content of solute Si in polygonal ferrite and bainitic ferrite; surface quality of the steel sheet due to generation of red scales or the like; and coatability and coating adhesion of plating when the steel sheet is subjected to hot dip galvanizing. Accordingly, the Si content in the steel is 3.0% or less, preferably 2.6% or less, and more preferably 2.2% or less.

The silicon content in the steel is preferably at least 0.5% because silicon is a useful element in terms of suppressing formation of carbide and facilitating formation of retained austenite. However, silicon need not be added and, thus, the Si content may be zero % in a case where formation of carbide is suppressed solely by aluminum.

Mn: 0.5% to 3.0%

Manganese is an element which effectively increases steel strength. A manganese content less than 0.5% in the steel causes carbides to be precipitated at a temperature higher than the temperature at which bainite and martensite are formed when a steel sheet is cooled after annealing, thereby making it impossible to reliably obtain a sufficient content of hard phase contributing to steel strengthening. A Mn content exceeding 3.0% may deteriorate forgeability of steel. Accordingly, the Mn content in the steel is 0.5% to 3.0% and is preferably 1.0% to 2.5%.

P: 0.1% or less

Phosphorus is a useful element in terms of increasing steel strength. However, a phosphorus content in the steel exceeding 0.1%: makes steel brittle due to grain boundary segregation of phosphorus to deteriorate impact resistance of a resulting steel sheet; and significantly slows the galvannealing (alloying) rate down in a case the steel sheet is subjected to galvannealing. Accordingly, phosphorus content in steel is 0.1% or less and preferably 0.05% or less. The lower limit of phosphorus content in steel is preferably around 0.005% because an attempt to reduce the phosphorus content below 0.005% significantly increases production costs, although the phosphorus content in the steel is to be decreased as best as possible.

S: 0.07% or less

Sulfur forms inclusions such as MnS and may be a cause of deterioration in impact resistance and generation of cracks along metal flow at a welded portion of a steel sheet. It is thus preferable that the sulfur content in the steel is reduced as best as possible. Presence of sulfur in steel, however, is tolerated unless the sulfur content in the steel exceeds 0.07%. The sulfur content in steel is preferably 0.05% or less, and more preferably 0.01% or less. The lower limit of the sulfur content in the steel is around 0.0005% in view of production costs because decreasing the sulfur content in the steel below 0.0005% significantly increases production costs.

Al: 3.0% or less

Aluminum is a useful element added as a deoxidizing agent in a steel manufacturing process. However, an aluminum content exceeding 3.0% may deteriorate ductility of a steel sheet due to too many inclusions in the steel sheet. Accordingly, the aluminum content in the steel is 3.0% or less and preferably 2.0% or less.

Further, aluminum is a useful element in terms of suppressing formation of carbide and facilitating formation of retained austenite. The aluminum content in the steel is preferably at least 0.001% and preferably at least 0.005% to sufficiently obtain a good deoxidizing effect of aluminum. The aluminum content represents the content of aluminum contained in a steel sheet after deoxidization.

N: 0.010% or less

Nitrogen is an element which most significantly deteriorates the anti-aging property of steel and thus the content thereof in the steel is preferably decreased as best as possible. A nitrogen content in steel exceeding 0.010% makes deterioration of the anti-aging property of the steel apparent. Accordingly, the nitrogen content in the steel is 0.010% or less. The lower limit of the nitrogen content in steel is around 0.001% in view of production costs because decreasing the nitrogen content in the steel below 0.001% significantly increases production costs.

The following component range also need be satisfied in addition to the aforementioned component ranges regarding the basic components.

Si+Al: at least 0.7%

Silicon and aluminum are useful elements, respectively, in terms of suppressing formation of carbides and facilitating formation of retained austenite. Such good effects of suppressing carbide formation caused by Si and Al as described above are each independently demonstrated when only one of Si and Al is included in the steel. However, these carbide formation-suppressing effects of Si and Al improve when the total content of Si and Al is at least 0.7%.

The composition of the steel sheet may further include, in addition to the aforementioned basic components, the following components in an appropriate manner.

At least one type of element selected from Cr: 0.05% to 5.0%, V: 0.005% to 1.0%, and Mo: 0.005% to 0.5%

Chromium, vanadium and molybdenum are elements which each suppress formation of pearlite when a steel sheet is cooled from the annealing temperature. These good effects of Cr, V and Mo are obtained when the contents of Cr, V and Mo in the steel are at least 0.05%, at least 0.005% and at least 0.005%, respectively. However, contents of Cr, V and Mo in the steel exceeding 5.0%, 1.0% and 0.5%, respectively, result in too much formation of hard martensite, which strengthens a resulting steel sheet excessively. Accordingly, in a case where the composition of the steel sheet includes at least one of Cr, V and Mo, the contents thereof are Cr: 0.05% to 5.0%, V: 0.005% to 1.0%, and Mo: 0.005% to 0.5%. At least one type of element selected from Ti: 0.01% to 0.1%, and Nb: 0.01% to 0.1%

Titanium and niobium are useful elements in terms of precipitate strengthening/hardening of steel. Titanium and niobium can each cause this effect when the contents thereof in the steel are at least 0.01%, respectively. In a case where at least one of the Ti and Nb content in the steel exceeds 0.1%, formability and shape fixability of a resulting steel sheet deteriorate. Accordingly, in a case where the steel sheet composition includes Ti and Nb, contents thereof are Ti: 0.01% to 0.1%, and Nb: 0.01% to 0.1%, respectively.

B: 0.0003% to 0.0050%

Boron is a useful element in terms of suppressing formation and growth of polygonal ferrite from an austenite grain boundary. This good effect of boron can be obtained when the boron content in the steel is at least 0.0003%. However, a boron content in the steel exceeding 0.0050% deteriorates formability of a resulting steel sheet. Accordingly, when the steel sheet composition includes boron, the boron content in steel is B: 0.0003% to 0.0050%.

At least one type of elements selected from Ni: 0.05% to 2.0%, and Cu: 0.05% to 2.0%

Nickel and copper are elements which each effectively increase strength of steel. These good effects of Ni and Cu are obtained when the contents thereof in the steel are at least 0.05%, respectively. In a case where at least one of Ni content and Cu content in steel exceeds 2.0%, formability of a resulting steel sheet deteriorates. Accordingly, in a case where the steel sheet composition includes Ni and Cu, the contents thereof are Ni: 0.05% to 2.0%, and Cu: 0.05% to 2.0%, respectively.

At least one element selected from Ca: 0.001% to 0.005% and REM: 0.001% to 0.005%

Calcium and REM are useful elements in terms of making sulfides spherical to lessen adverse effects of the sulfides on a steel sheet. Calcium and REM can each cause this effect when the contents thereof in the steel are at least 0.001%, respectively. In a case where at least one of the Ca and REM content in the steel exceeds 0.005%, inclusions increase and cause surface defects, internal defects and the like of a resulting steel sheet. Accordingly, in a case where the steel sheet composition includes Ca and REM, the contents thereof are Ca: 0.001% to 0.005% and REM: 0.001% to 0.005%, respectively.

Components other than those described above are Fe and incidental impurities in the steel sheet. However, our steel sheets do not exclude the possibility that the steel composition thereof includes a component other than those described above unless inclusion of the component has an adverse effect.

Next, a method for manufacturing a high strength press-formed member will be described.

First, a steel material is prepared to have the preferred component composition described above and the steel material is subjected to hot rolling and optionally cold rolling to be finished to a steel sheet material. The processes for hot rolling and cold rolling of a steel material are not particularly restricted and may be carried out according to conventional methods.

Examples of typical manufacturing conditions of a steel sheet material include: heating a steel material to temperature in the range of 1000° C. to 1300° C.; finishing hot rolling at temperature in the range of 870° C. to 950° C.; and then subjecting the steel sheet material to coiling at temperature in the range of 350° C. to 720° C. to obtain a hot rolled steel sheet. The hot rolled steel sheet thus obtained may further be subjected to pickling and cold rolling at rolling reduction rate of 40% to 90% to obtain a cold rolled steel sheet.

It is acceptable when the steel sheet material is manufactured to skip at least a part of the hot rolling process by employing thin slab casting, strip casting or the like.

The steel sheet material thus obtained is processed in the following processes to be finished to a high strength press-formed member.

First, the steel sheet material is subjected to a heating process. Regarding heating temperature and retention time during the heating process, the steel sheet material is to be heated to a temperature of 750° C. to 1000° C. and retained in that state for 5 seconds to 1000 seconds to suppress coarsening of crystal grains and deterioration of productivity. A heating temperature lower than 750° C. may result in insufficient dissolution of carbides in the steel sheet material and possible failure in obtaining the targeted properties of the steel sheet material.

On the other hand, the heating temperature exceeding 1000° C. causes austenite grains to grow excessively, thereby coarsening the structural phases generated by cooling thereafter to deteriorate toughness and the like of the steel sheet material. Accordingly, the heating temperature is 750° C. to 1000° C.

Retention time during which the steel sheet material is retained at the aforementioned temperature is 5 seconds to 1000 seconds. When the retention time is shorter than 5 seconds, reverse transformation to austenite may not proceed sufficiently and/or carbides in the steel sheet material may not be dissolved sufficiently. When the retention time exceeds 1000 seconds, the production cost increases due to too much energy consumption. Accordingly, the retention time is 5 seconds to 1000 seconds and preferably 60 seconds to 500 seconds.

A temperature range within which hot press-forming is carried out needs to be 350° C. to 900° C. When the steel sheet material is subjected to hot press-forming at a temperature lower than 350° C., martensitic transformation may partially proceed and the formability-improving effect by hot press-forming may not be attained in a satisfactory manner. When the steel sheet material is subjected to hot press-forming at temperature exceeding 900° C., a mold may be significantly damaged during hot press-forming to increase production costs.

The steel sheet material is then cooled down to a temperature in a first temperature region of 50° C. to 350° C. so that a portion of martensite proceeds to martensitic transformation. The steel sheet material thus cooled is heated to the austempering temperature of 350° C. to 490° C., i.e. a second temperature region as the bainitic transformation temperature region, and retained at the temperature for a period ranging from 5 seconds to 1000 seconds to reliably obtain retained austenite in a stable state.

An increase in temperature, from the first temperature region after the cooling up to the second temperature, is preferably carried out within 3600 seconds.

Regarding the first temperature region, when the steel sheet material is cooled to a temperature below 50° C., most of non-transformed austenite proceeds to martensitic transformation at this stage and sufficient content of bainite (bainitic ferrite and retained austenite) cannot be reliably obtained. When the steel sheet material fails to be cooled to a temperature equal to or lower than 350° C., tempered martensite cannot be reliably obtained by adequate content. Accordingly, the first temperature region is 50° C. to 350° C.

Martensite formed by the cooling process from the annealing temperature down to the first temperature region is tempered and non-transformed austenite is transformed into bainite at a tempering temperature in the second temperature region. When the tempering temperature is lower than 350° C., bainite is mainly constituted of lower bainite and the average carbon concentration in austenite may be insufficient. When the tempering temperature exceeds 490° C., carbides may be precipitated from non-transformed austenite and the desired microstructure may not be obtained. Accordingly, the second temperature region is 350° C. to 490° C. and preferably 370° C. to 460° C.

When the retention time during which the steel sheet material is retained at temperature in the second temperature region is shorter than 5 seconds, tempering of martensite and/or bainitic transformation may be insufficient and the desired microstructures may not be obtained in a resulting steel sheet, which results in poor formability of the steel sheet. When the retention time in the second temperature region exceeds 1000 seconds, carbides are precipitated from non-transformed austenite and stable retained austenite having a relatively high carbon concentration cannot be obtained as the final microstructure of a resulting steel sheet, whereby a resulting steel sheet may fail at least one of the desired strength and ductility. Accordingly, the retention time at a temperature in the second temperature region is 5 seconds to 1000 seconds, preferably 15 seconds to 600 seconds, and more preferably 40 seconds to 400 seconds.

The retention temperature in the series of thermal treatments in need not be constant and may vary within such predetermined temperature ranges as described above. In other words, variations in each retention temperature within the predetermined temperature range do not have an adverse effect. Similar tolerance is applied to the cooling rate. Further, the steel sheet may be subjected to the relevant thermal treatments in any facilities as long as the required thermal history is satisfied.

EXAMPLES

Our steel sheets and methods will be described further in detail by Examples hereinafter. These Examples, however, do not restrict this disclosure by any means. Any changes in structure within the primary features are included within the scope of this disclosure.

A steel material, obtained from steel having a component composition as shown in Table 1 by using ingot techniques, was heated to 1200° C. and subjected to finish hot rolling at 870° C. to obtain a hot rolled steel sheet. The hot rolled steel sheet was subjected to coiling at 650° C., pickling, and cold rolling at rolling reduction rate of 65% to obtain a cold rolled steel sheet sample having sheet thickness: 1.2 mm.

Each of the cold rolled steel sheet samples thus obtained was subjected to heating, retention, hot press-forming, cooling and thermal treatment under the conditions shown in Table 2, whereby a hat-shaped high strength press-formed member sample was prepared. A mold having punch width: 70 mm, punch nose radius: 4 mm, die shoulder radius: 4 mm, and forming depth: 30 mm was used. Specifically, the cold rolled steel sheet sample was heated in ambient air by using either an infrared heating furnace or an atmosphere furnace. The cooling process was then carried out by combining: interposing the steel sheet sample between the punch and the die; and leaving the steel sheet, released from the interposed state, on the die for air-cooling. The heating for tempering and retention, after the cooling process, was carried out by using a salt bath furnace.

TABLE 1

| | Steel components (mass %) | | | | | | | | | | | | | | | | | | |
|---|---|---|---|---|---|---|---|---|---|---|---|---|---|---|---|---|---|---|---|
| Steel type | C | Si | Mn | Al | P | S | N | Cr | V | Mo | Ti | Nb | B | Ni | Cu | Ca | REM | Si + Al | Note |
| A | 0.155 | 1.49 | 2.52 | 0.045 | 0.019 | 0.0038 | 0.0028 | — | — | — | — | — | — | — | — | — | — | 1.54 | Steel |
| B | 0.105 | 0.55 | 1.56 | 0.450 | 0.007 | 0.0016 | 0.0038 | — | — | — | — | — | — | — | — | — | — | 1.00 | Comparative steel |
| C | 0.186 | 1.48 | 2.20 | 0.043 | 0.018 | 0.0020 | 0.0043 | — | — | — | — | 0.08 | — | — | — | — | — | 1.52 | Steel |
| D | 0.193 | 1.83 | 2.45 | 0.045 | 0.041 | 0.0019 | 0.0045 | — | — | — | 0.040 | — | — | — | — | — | — | 1.88 | Steel |
| E | 0.198 | 1.12 | 0.42 | 0.035 | 0.020 | 0.0025 | 0.0041 | — | — | — | — | — | — | — | — | — | — | 1.16 | Comparative steel |
| F | 0.204 | 1.55 | 2.41 | 0.042 | 0.028 | 0.0015 | 0.0030 | — | — | — | 0.022 | — | 0.0011 | — | — | — | — | 1.59 | Steel |
| G | 0.212 | 1.31 | 1.93 | 0.039 | 0.039 | 0.0027 | 0.0041 | — | — | 0.22 | — | — | — | — | — | — | — | 1.35 | Steel |
| H | 0.253 | 1.49 | 2.25 | 0.038 | 0.010 | 0.0012 | 0.0034 | 0.7 | — | — | — | — | — | — | — | — | — | 1.53 | Steel |
| I | 0.281 | 1.37 | 2.31 | 0.041 | 0.005 | 0.0020 | 0.0033 | — | 0.31 | — | — | — | — | — | — | — | — | 1.41 | Steel |
| J | 0.281 | 2.01 | 1.94 | 0.042 | 0.011 | 0.0018 | 0.0032 | — | — | — | — | — | — | — | — | — | — | 2.05 | Steel |
| K | 0.290 | 0.48 | 2.22 | 0.130 | 0.006 | 0.0020 | 0.0035 | — | — | — | — | — | — | — | — | — | — | 0.61 | Comparative steel |
| L | 0.291 | 0.01 | 2.75 | 0.042 | 0.012 | 0.0040 | 0.0024 | — | — | — | — | — | — | — | — | — | — | 0.05 | Comparative steel |
| M | 0.300 | 0.01 | 2.50 | 1.100 | 0.025 | 0.0020 | 0.0030 | — | — | — | — | — | — | — | — | — | — | 1.11 | Steel |
| N | 0.303 | 2.49 | 2.01 | 0.041 | 0.010 | 0.0011 | 0.0040 | — | — | — | — | — | — | — | — | — | — | 2.53 | Steel |
| O | 0.308 | 1.88 | 1.52 | 0.039 | 0.007 | 0.0022 | 0.0029 | — | — | — | — | — | — | — | — | — | — | 1.92 | Steel |
| P | 0.310 | 1.42 | 2.75 | 0.042 | 0.013 | 0.0029 | 0.0039 | — | — | — | — | — | — | — | — | — | — | 1.46 | Steel |
| Q | 0.320 | 1.39 | 1.98 | 0.044 | 0.016 | 0.0030 | 0.0025 | — | — | — | — | — | — | — | 0.57 | — | — | 1.43 | Steel |
| R | 0.340 | 1.91 | 1.65 | 0.042 | 0.022 | 0.0022 | 0.0035 | — | — | — | — | — | — | — | — | — | 0.002 | 1.95 | Steel |
| S | 0.341 | 1.98 | 2.00 | 0.039 | 0.004 | 0.0031 | 0.0039 | — | — | — | — | — | — | — | — | 0.002 | — | 2.02 | Steel |
| T | 0.360 | 0.99 | 2.10 | 0.041 | 0.016 | 0.0020 | 0.0040 | — | — | — | — | — | — | — | — | — | — | 1.03 | Steel |
| U | 0.408 | 1.96 | 1.55 | 0.036 | 0.012 | 0.0018 | 0.0019 | — | — | — | — | — | — | — | — | — | — | 2.00 | Steel |
| V | 0.417 | 1.99 | 2.02 | 0.044 | 0.010 | 0.0020 | 0.0029 | — | — | — | — | — | — | — | — | — | — | 2.03 | Steel |
| W | 0.476 | 1.49 | 1.28 | 0.041 | 0.014 | 0.0021 | 0.0030 | — | — | — | — | — | — | 0.45 | — | — | — | 1.53 | Steel |
| X | 0.599 | 1.53 | 1.51 | 0.040 | 0.011 | 0.0025 | 0.0040 | — | — | — | — | — | — | — | — | — | — | 1.57 | Steel |

TABLE 2

| Sample No. | Steel type | Heating temperature (° C.) | Retention time (s) | Press-forming temperature (° C.) | Cooling stop temperature (° C.) | Retention temperature in second temperature region (° C.) | Retention time in second temperature region (s) | Note |
|---|---|---|---|---|---|---|---|---|
| 1 | A | 910 | 180 | 880 | 250 | 380 | 90 | Example |
| 2 | B | 900 | 200 | 850 | 300 | 400 | 200 | Comp. Example |
| 3 | C | 900 | 200 | 720 | 260 | 420 | 100 | Example |
| 4 | D | 920 | 250 | 550 | 250 | 400 | 170 | Example |
| 5 | E | 920 | 150 | 740 | 200 | 400 | 80 | Comp. Example |
| 6 | F | 890 | 220 | 770 | 240 | 400 | 90 | Example |
| 7 | G | 890 | 300 | 680 | 240 | 400 | 220 | Example |
| 8 | H | 910 | 150 | 700 | 260 | 380 | 100 | Example |
| 9 | I | 920 | 180 | 770 | 250 | 400 | 110 | Example |
| 10 | J | 890 | 150 | 730 | 250 | 420 | 120 | Example |
| 11 | K | 900 | 200 | 820 | 250 | 400 | 100 | Comp. Example |
| 12 | L | 900 | 200 | 820 | 250 | 400 | 100 | Comp. Example |
| 13 | M | 920 | 200 | 850 | 250 | 400 | 150 | Example |
| 14 | N | 920 | 250 | 700 | 200 | 410 | 120 | Example |
| 15 | O | 730 | 400 | 700 | 190 | 400 | 100 | Comp. Example |
| 16 | O | 880 | 200 | 750 | 390 | 390 | 300 | Comp. Example |
| 17 | O | 880 | 200 | 750 | 20 | 430 | 100 | Comp. Example |
| 18 | O | 900 | 120 | 730 | 250 | 400 | 90 | Example |
| 19 | P | 850 | 350 | 760 | 200 | 350 | 80 | Example |
| 20 | Q | 910 | 180 | 450 | 240 | 410 | 120 | Example |

TABLE 2-continued

| Sample No. | Steel type | Heating temperature (° C.) | Retention time (s) | Press-forming temperature (° C.) | Cooling stop temperature (° C.) | Retention temperature in second temperature region (° C.) | Retention time in second temperature region (s) | Note |
|---|---|---|---|---|---|---|---|---|
| 21 | R | 910 | 180 | 750 | 240 | 400 | 100 | Example |
| 22 | S | 890 | 200 | 680 | 200 | 400 | 90 | Example |
| 23 | T | 880 | 200 | 750 | 240 | 400 | 60 | Example |
| 24 | U | 880 | 250 | 800 | 250 | 380 | 100 | Example |
| 25 | V | 900 | 180 | 650 | 140 | 400 | 90 | Example |
| 26 | W | 880 | 200 | 760 | 200 | 400 | 350 | Example |
| 27 | X | 850 | 350 | 800 | 90 | 420 | 500 | Example |

Various properties of each of the hat-shaped high strength press-formed member samples thus obtained were evaluated by the following methods.

A JIS No. 5 test piece and a test sample for analysis were collected, respectively, from a position at the hat bottom of each hat-shaped high strength press-formed member sample. Microstructures of ten fields of the test sample for analysis were observed by using a×3000 scanning electron microscope (SEM) to measure area ratios of respective phases and identify phase structures of respective crystal grains.

The quantity of retained austenite was determined by first grinding/polishing the high strength press-formed member sample in the sheet thickness direction to a (thickness×¼) position and then carrying out X-ray diffraction intensity measurement. Specifically, the quantity of retained austenite was determined by using Co—Kα as incident X-ray and carrying out necessary calculations based on ratios of diffraction intensities of the respective faces (200), (220), (311) of austenite with respect to diffraction intensities of the respective faces (200), (211) and (220) of ferrite. The quantity of retained austenite thus determined is shown as the area ratio of retained austenite of each high strength press-formed member sample in Table 3.

The average carbon concentration in the retained austenite was determined by: obtaining a relevant lattice constant from the intensity peaks of the respective faces (200), (220), (311) of austenite acquired by X-ray diffraction intensity measurement; and substituting the lattice constant for [$a_0$] in the following formula:

$$[C\ \%]=(a_0-0.3580-0.00095\times[Mn\ \%]-0.0056\times[Al\ \%]-0.022\times[N\ \%])/0.0033$$

wherein $a_0$: lattice constant (nm) and [X %]: mass % of element "X."

"Mass % of element X" (other than that of carbon) represents mass % of element X with respect to a steel sheet as a whole. In a case where content of retained austenite is 3% or lower, the result was regarded as "measurement failure" because intensity peaks are too low to accurately measure peak positions in such a case.

A tensile test was carried out according to JIS Z 2241 by using a JIS No. 5 test piece collected as described above. TS (tensile strength), T.EL. (total elongation) of the test piece were measured and the product of the tensile strength and the total elongation (TS×T.EL.) was calculated to evaluate balance between strength and formability (ductility) of the steel sheet sample. TS×T.EL. 17000 (MPa·%) is evaluated to be good.

The evaluation results determined as described above are shown in Table 3.

TABLE 3

| | | Area ratio (%) | | | | | | | | Carbon concetration | | | | |
|---|---|---|---|---|---|---|---|---|---|---|---|---|---|---|
| Sample No. | Steel type | αb | M | tM | α | γ※ | Remainder | αb + M + γ | tM/M % | in retained γ (%) | TS (MPa) | T. EL (%) | TS × T. EL (MPa · %) | Note |
| 1 | A | 42 | 45 | 18 | 5 | 8 | 0 | 95 | 40 | 0.72 | 1035 | 21 | 21735 | Example |
| 2 | B | 75 | 9 | 4 | 6 | 1 | 9 | 85 | 44 | — | 842 | 15 | 12630 | Comp. Example |
| 3 | C | 32 | 57 | 39 | 0 | 11 | 0 | 100 | 68 | 0.79 | 1042 | 24 | 25008 | Example |
| 4 | D | 31 | 60 | 42 | 0 | 9 | 0 | 100 | 70 | 0.81 | 1301 | 18 | 23418 | Example |
| 5 | E | 7 | 0 | — | 75 | 0 | 18 | 7 | — | — | 735 | 14 | 10290 | Comp. Example |
| 6 | F | 36 | 55 | 43 | 0 | 9 | 0 | 100 | 78 | 0.82 | 1278 | 22 | 28116 | Example |
| 7 | G | 20 | 69 | 50 | 0 | 11 | 0 | 100 | 72 | 0.72 | 1845 | 10 | 18450 | Example |
| 8 | H | 18 | 69 | 59 | 6 | 7 | 0 | 94 | 86 | 0.80 | 1752 | 12 | 21024 | Example |
| 9 | I | 21 | 70 | 49 | 0 | 9 | 0 | 100 | 70 | 0.83 | 1599 | 15 | 23985 | Example |
| 10 | J | 68 | 15 | 10 | 6 | 11 | 0 | 94 | 67 | 0.97 | 1345 | 17 | 22865 | Example |
| 11 | K | 43 | 50 | 30 | 5 | 2 | 0 | 95 | 60 | — | 1310 | 10 | 13100 | Comp. Example |
| 12 | L | 37 | 43 | 26 | 10 | 3 | 7 | 83 | 60 | — | 1035 | 13 | 13455 | Comp. Example |
| 13 | M | 38 | 42 | 24 | 8 | 12 | 0 | 92 | 57 | 1.03 | 1342 | 21 | 28182 | Example |
| 14 | N | 55 | 28 | 20 | 6 | 11 | 0 | 94 | 71 | 1.01 | 1465 | 18 | 26370 | Example |
| 15 | O | 5 | 3 | 0 | 72 | 2 | 18 | 10 | 0 | — | 842 | 15 | 12630 | Comp. Example |
| 16 | O | 44 | 39 | 4 | 5 | 12 | 0 | 95 | 10 | 0.99 | 1367 | 10 | 13670 | Comp. Example |
| 17 | O | 0 | 99 | 99 | 0 | 1 | 0 | 100 | 100 | — | 1778 | 7 | 12446 | Comp. Example |
| 18 | O | 73 | 12 | 9 | 5 | 10 | 0 | 95 | 75 | 1.08 | 1401 | 15 | 21015 | Example |
| 19 | P | 40 | 50 | 22 | 0 | 10 | 0 | 100 | 44 | 0.78 | 1612 | 16 | 25792 | Example |
| 20 | Q | 42 | 44 | 30 | 0 | 14 | 0 | 100 | 68 | 0.92 | 1546 | 15 | 23190 | Example |
| 21 | R | 58 | 29 | 17 | 0 | 13 | 0 | 100 | 59 | 1.06 | 1432 | 17 | 24344 | Example |
| 22 | S | 21 | 68 | 49 | 0 | 11 | 0 | 100 | 72 | 0.92 | 1486 | 14 | 20804 | Example |
| 23 | T | 37 | 53 | 19 | 1 | 9 | 0 | 99 | 36 | 0.85 | 1421 | 14 | 19894 | Example |
| 24 | U | 62 | 21 | 15 | 4 | 13 | 0 | 96 | 71 | 1.18 | 1412 | 21 | 29652 | Example |

TABLE 3-continued

| Sample No. | Steel type | Area ratio (%) αb | M | tM | α | γ※ | Remainder | αb + M + γ | tM/M % | Carbon concetration in retained γ (%) | TS (MPa) | T. EL (%) | TS × T. EL (MPa · %) | Note |
|---|---|---|---|---|---|---|---|---|---|---|---|---|---|---|
| 25 | V | 54 | 29 | 20 | 2 | 15 | 0 | 98 | 69 | 0.96 | 1633 | 16 | 26128 | Example |
| 26 | W | 32 | 53 | 37 | 0 | 15 | 0 | 100 | 70 | 0.89 | 1735 | 14 | 24290 | Example |
| 27 | X | 12 | 82 | 68 | 0 | 6 | 0 | 100 | 83 | 1.02 | 1912 | 11 | 21032 | Example |

αb: Bainitic ferrite in bainite
M: Martensite
tM: Tempered martensite
α: Polygonal ferrite
γ: Retained austenite
※ Retained austenite content determined by X-ray diffraction intensity measurement is shown as area ratio of retained austenite with respect to the entire microstructure of a steel sheet for each sample.

As is obvious from Table 3, our high strength press-formed member samples all satisfied a tensile strength of at least 980 MPa and TS×T.EL. 17000 (MPa·%). That is, it was confirmed that these member samples all have sufficiently high strength and excellent ductility in a compatible manner.

INDUSTRIAL APPLICABILITY

It is possible to obtain a high strength press-formed member being excellent in ductility and having tensile strength (TS) of at least 980 MPa by setting carbon content in a steel sheet to be at least 0.12% and specifying area ratios of martensite, retained austenite and bainite containing bainitic ferrite with respect to the entire microstructure of the steel sheet and the average carbon concentration in the retained austenite, respectively.

The invention claimed is:

1. A method of manufacturing a high strength press-formed member, comprising:

preparing a steel sheet having a composition including by mass %:
C: 0.12% to 0.69%,
Si: 3.0% or less,
Mn: 0.5% to 3.0%,
P: 0.1% or less,
S: 0.07% or less,
Al: 3.0% or less,
N: 0.010% or less,
Si+Al: at least 0.7%, and
remainder as Fe and incidental impurities;

heating the steel sheet to a temperature of 750° C. to 1000° C. and retaining the steel sheet in that state for 5 seconds to 1000 seconds;

subjecting the steel sheet to hot press-forming at a temperature of 350° C. to 900° C.;

cooling the steel sheet to a temperature of 50° C. to 350° C.;

heating the steel sheet to a temperature in a temperature region of 350° C. to 490° C.; and retaining the steel sheet at the temperature in the temperature region for 5 seconds to 1000 seconds, wherein a microstructure of a steel sheet constituting the high strength press-formed member comprises martensite, retained austenite and bainite containing bainitic ferrite, an area ratio of said martensite with respect to the entire microstructure of the steel sheet is 10% to 57%, at least 25% of said martensite is tempered martensite, content of retained austenite is 5% to 40%, area ratio of said bainitic ferrite in said bainite with respect to the entire microstructure of the steel sheet is at least 5%, total of area ratios of said martensite, said retained austenite, and said bainitic ferrite in said bainite with respect to the entire microstructure of the steel sheet is at least 65%, area ratio of remaining microstructure with respect to the entire microstructure of the steel sheet is 20% or less, and average carbon concentration in the retained austenite is at least 0.65 mass %.

2. The method of claim 1, wherein the composition of the steel sheet further comprises by mass % at least one group selected from (A) to (E), wherein (A) at least one element selected from
Cr: 0.05% to 5.0%,
V: 0.005% to 1.0%, and
Mo: 0.005% to 0.5%, (B) at least one element selected from
Ti: 0.01% to 0.1%, and
Nb: 0.01% to 0.1%, (C) B: 0.0003% to 0.0050%, (D) at least one element selected from
Ni: 0.05% to 2.0%, and
Cu: 0.05% to 2.0%, (E) at least one element selected from
Ca: 0.001% to 0.005%, and
REM: 0.001% to 0.005%.

3. The method of claim 1, wherein the composition of the steel sheet further comprises by mass % at least one element from the group consisting of:
Cr: 0.05% to 5.0%,
V: 0.005% to 1.0%, and
Mo: 0.005% to 0.5%.

4. The method of claim 1, wherein the composition of the steel sheet further comprises by mass % at least one element from the group consisting of:
Ti: 0.01% to 0.1%, and
Nb: 0.01% to 0.1%.

5. The method of claim 4, wherein the composition of the steel sheet further comprises by mass % B: 0.0003% to 0.0050%.

6. The method of claim 1, wherein the composition of the steel sheet further comprises by mass % at least one element from the group consisting of:
Ni: 0.05% to 2.0%, and
Cu: 0.05% to 2.0%.

7. The method of claim 1, wherein the composition of the steel sheet further comprises by mass % at least one element form the group consisting of:
Ca: 0.001% to 0.005%, and
REM: 0.001% to 0.005%.

8. The method of claim 2, wherein the C content of the steel sheet is by mass % 0.281% to 0.69%.

9. The method of claim 1, wherein the C content of the steel sheet is by mass % 0.360% to 0.69%.

10. The method of claim 1, wherein the temperature at which the cooling is performed is 140° C. to 350° C.

* * * * *